United States Patent [19]

Neville

[11] Patent Number: 4,554,933

[45] Date of Patent: Nov. 26, 1985

[54] TOBACCO OPENING AND CONDITIONING APPARATUS

[75] Inventor: Richard E. Neville, Salisbury, England

[73] Assignee: AMF Incorporated, White Plains, N.Y.

[21] Appl. No.: 420,221

[22] PCT Filed: Dec. 16, 1981

[86] PCT No.: PCT/GB81/00272

§ 371 Date: Sep. 13, 1982

§ 102(e) Date: Sep. 13, 1982

[87] PCT Pub. No.: WO82/02324

PCT Pub. Date: Jul. 22, 1982

[30] Foreign Application Priority Data

| | | | |
|---|---|---|---|
| Jan. 15, 1981 | [GB] | United Kingdom | 8101201 |
| Oct. 1, 1981 | [GB] | United Kingdom | 8129689 |
| Nov. 24, 1981 | [GB] | United Kingdom | 8135442 |

[51] Int. Cl.[4] ..... A24B 3/06

[52] U.S. Cl. ..... 131/304; 131/306

[58] Field of Search ..... 131/300, 301, 302, 303, 131/304, 306; 239/184

[56] References Cited

U.S. PATENT DOCUMENTS

| | | | |
|---|---|---|---|
| 1,507,054 | 8/1921 | Folsche | 239/184 |
| 1,693,989 | 7/1925 | Milligan | 131/304 |
| 4,222,397 | 9/1980 | Brackmann et al. | 131/306 |
| 4,307,736 | 12/1981 | Brackmann et al. | 131/306 |
| 4,349,037 | 9/1982 | Brackmann et al. | 131/306 |

FOREIGN PATENT DOCUMENTS

| | | | |
|---|---|---|---|
| 808990 | 3/1969 | Canada | 131/304 |
| 2047070 | 11/1980 | United Kingdom . | |

*Primary Examiner*—V. Millin
*Assistant Examiner*—H. Macey
*Attorney, Agent, or Firm*—David E. Dougherty; John H. Gallagher

[57] ABSTRACT

Apparatus for opening and pre-conditioning a case or hogshead of tobacco in which the tobacco is a laminated body, comprises a chamber for receiving the laminated tobacco body and device for emitting an air/moisture jet stream in said chamber capable of being reciprocated in a plane parallel to and in close proximity to the tobacco laminae or of being rotated in the plane about an axis normal to the plane to lift one lamina or more progressively from the tobacco body.

Additional structure may be provided whereby water may be added to the jet stream and the separated tobacco fed directly to a silo to await cutting without further treatment.

16 Claims, 16 Drawing Figures

Figure 1:
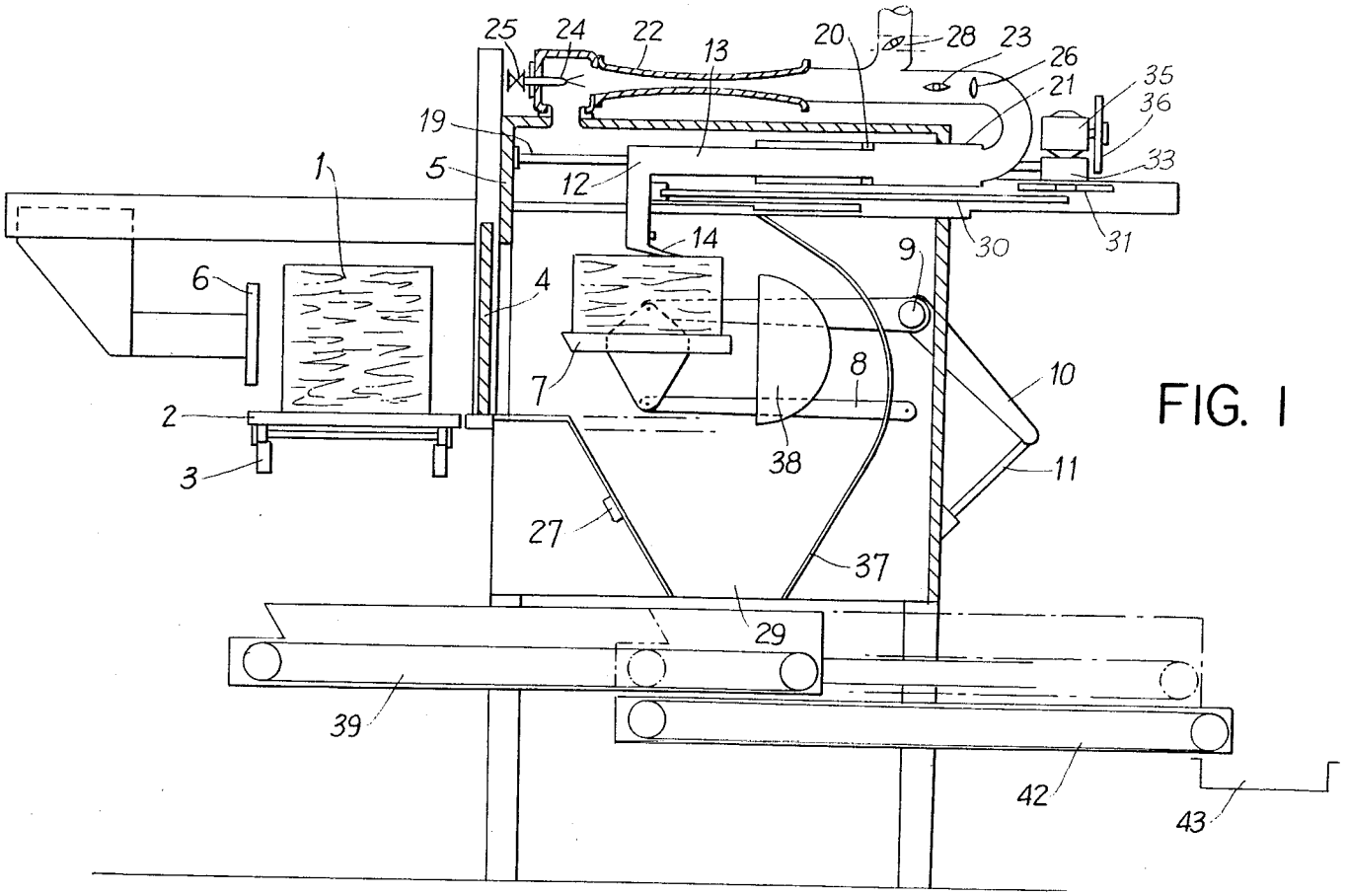

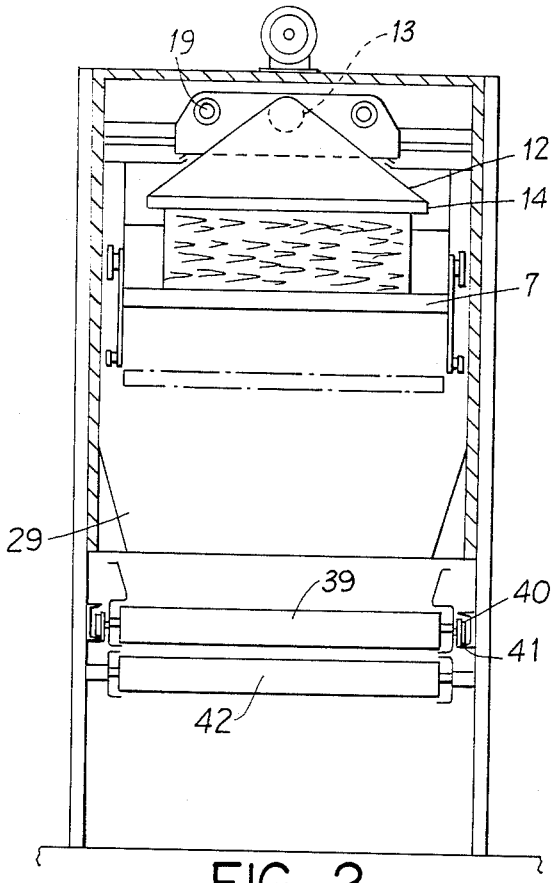
FIG. 2
FIG. 3
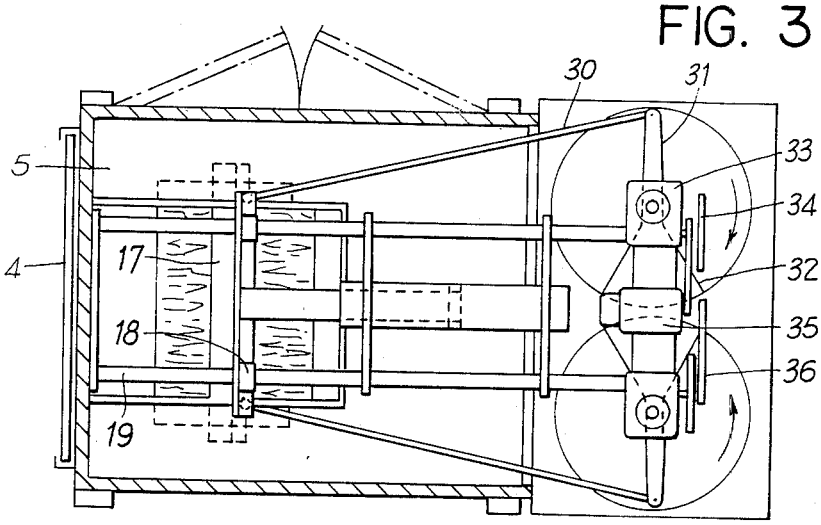

TOBACCO OPENING AND CONDITIONING APPARATUS

This invention relates to an apparatus and process for the continuous preconditioning and opening of cases and hogsheads of tobacco lamina (i.e. moistening and then separating the lamina).

The cases or hogsheads of lamina are stored at room temperature with only 12% moisture content and at an average bulk density of 20 to 24 lbs/ft$^3$ (320 to 384 kg/m$^3$). At this moisture content and bulk density the lamina is very friable and very tightly packed. Any attempt to open the tobacco (i.e. separate the lamina) under these conditions results in degradation (i.e. breakage of the lamina).

The pre-conditioning process is a condensation process in which saturated air heats the tobacco by condensation adding approximately 1% moisture per 22° F. (12° C.) depending on the specific beat. The added moisture is largely temporary (false order) and can be lost by cooling the tobacco in ventilated conditions.

The tobacco is normally heated to 170° F. (77° C.) which adds approximately 5% moisture content. At this condition the lamina is flaccid and can be opened without damage.

Opening can be carried out manually or by tipping the bulk into the hopper of an autofeed, which may comprise an elevator band with pins, which draw the lamina from the bulk. Permanent moisture is added to the laminae in a subsequent process such as a recirculating cylinder.

Due to the way cases and hogsheads are packed the lamina is largely lying in parallel planes and the case or hogshead cleaves more readily in these planes.

The problem of pre-conditioning is to get moisture to penetrate between the tightly packed leaves before they are removed. The difficulty of doing this is related to the packing density. The problem of opening is to remove laminae without breakage and this is dependant on the condition and the relationship of the removal means to the planes of lamination.

One process for pre conditioning is known in which the case or hogshead is placed in a vacuum chamber, and the air is evacuated and replaced by steam which is condensed on the tobacco to heat and moisten it. The penetration is dependent on density and there is usually a high density 'hard spot' or 'cold spot' which has not pre-conditioned even after repeating the evacuation and steam back cycles several times.

In a further process the pre-conditioning is carried out in a chamber at atmospheric pressure. Such a process known as the compressed tobacco conditioning (CTC) process is described in U.K. Pat. No. 781,365 of the British Imperial Tobacco Company of Canada, and features a perforated probe inserted into the hogshead whereby saturated air is drawn through the tobacco. Water vapour condenses on the tobacco heating and moistening it.

The main weakness of the two batch processes above is that the processes are slow and so to achieve the production rate, several cases or hogsheads are preconditioned at one time in large chambers. The resultant output of several cases or hogsheads at one time means that the last to be opened has remained standing for 30 to 40 minutes losing condition (moisture).

U.K. Pat. No. 947,291 to John Mohr & Sons discloses a combined probe and vacuum chamber reducing the cycle time to 12 to 15 minutes. A three-probe device, described in U.K. Pat. No. 1,493,443, speeds the process up to a 6 minute cycle time.

The first continuous pre-conditioners, in which the tobacco is moistened and opened in the one operation were disclosed in U.K. Pat. Nos. 1,023,470 and 1,136,439 to Bowen in which the face parallel with the laminations is treated with moist air or steam to both condition and peel off the lead in a single operation. The cases are turned through 90° so that the plane of laminations is vertical and a succession of such cases conveyed continuously into a treatment chamber, with the planes of lamination at right angles to the direction of conveying.

The disadvantages of the latter machine are:

1. The case can de-laminate when turned through 90°.
2. The last layers of a case being processed can collapse and jam under the doffer or give a surge of output.
3. The operating path of each doffer is cylindrical whereby the curved path cuts through the laminations degrading the lamina size.
4. No provision has been made for sealing the cases where they enter the chamber or at the lamina discharge. Convection current from outlet to inlet result in excessive saturated air escape and difficulty in maintaining a working temperature.
5. The fixed sprays of steam and water in the arrangement described in U.S. Pat. No. 1,023,470 are too far from the tobacco face to carry sufficient energy to strip leaf as claimed and mechanical assistance as described would be essential. The fixed jet at the top edge of the tobacco face according to U.S. Pat. No. 1,136,439 is still too far from the lower parts of the face to carry sufficient energy to strip leaf and is not claimed to do so.
6. The process is not suitable for hogsheads.

The first commercially successful continuous preconditioner and opener is described in U.K. Pat. No. 1,364,839 of Dickinson. However, the arrangement described does have some disadvantages, e.g. uneven conditioning, high power needed for vacuum and the perforated probes readily become blocked.

The Rothman machines, described in U.K. patent appln. No. 2007962A (corresponding to U.S. Pat. No. 4,222,397) and U.K. patent appln. No. 2057070A have a similar doffer-to-case relationship as that of the Dickinson machine of U.S. Pat. No. 1,364,839. Both the Dickinson and Rothmans devices have doffers describing cylindrical paths rotating about an axis lying in the plane of the laminations of the tobacco leaf. The probe in Dickinson is dispensed with.

Some of the disadvantages of the machine disclosed in U.S. Pat. No. 4,222,397 are that some lamina will be removed without pre-conditioning as the steam directed essentially obliquely to the lamina does not adequately penetrate the lamina and since the steam will be dry and at a temperature well above boiling point will affect the colour and flavour of the tobacco. Also a blunt edge moving at right angles to the direction of removal will cause some degradation and bruising. Further, in both the Rothmans and Dickinson machines the case or hogshead is liable to collapse as the final layers are removed.

An object of the present invention is to seek to overcome one or more of the disadvantages described above to minimise degradation yet preferably being capable of treating both cases and hogsheads.

According to the present invention there is provided a process for the opening and pre-conditioning of a case of hogshead of tobacco comprising a body of laminae, in which at least one air/moisture strip jet is reciprocated in a plane parallel to and in close proximity to the tobacco laminae, or is rotated in said plane about an axis normal to said plane, whereby the strip jet separates one or more laminae progressively from the body of the tobacco.

Further according to the invention there is provided an apparatus for opening and pre-conditioning a case or hogshead of tobacco in which the tobacco is a laminated body, comprising a chamber for receiving the laminated tobacco body and means for emitting an air/-moisture strip jet in said chamber capable of being reciprocated in a plane parallel to and in close proximity to the tobacco laminae or of being rotated in said plane about an axis normal to said plane to lift one lamina or more progressively from the tobacco body.

The tobacco and jet means may be contained in a chamber having a sealed inlet door. The jet means are supplied with hot saturated air under pressure from an ejector, fan or blower. The temperature for the saturated air is expediently controlled by adjusting the proportions of air and steam.

The strip jet preferably is directed at a glancing angle to the tobacco surface and the pressure at the jet and its proximity to the tobacco surface is such that the saturated air penetrates between the laminae and both conditions and peels or lifts the lamina from the surface.

The case or hogshead may be raised slowly towards the moving strip jet or jets, or the strip jet or jets are slowly lowered on to the case or hogshead to remove the laminae progressively.

A tangential separator or cyclone separator may separate the laminae and saturated air, which is recirculated back to the ejector fan or blower.

The strip jet may include water sprays for adding permanent moisture and a peeling or skiving blade for assisting in the removal of extraordinarily densely packed laminae.

At the discharge point a traversing storage conveyor may be used which stores a proportion of the laminae during processing and discharges it during the period of changeover of cases or hogsheads, so as to maintain a continuous output of tobacco, where this is required.

In known apparatus permanent moisture is added in a separate conditioning cylinder, before the tobacco is stored in a silo to await cutting. Typically the cylinder would increase the moisture 4 or 5%.

Prior processes have also been known in which water sprays have been included to ensure saturation of the air, but not with a view to bringing the tobacco up to cutting moistures of 18 to 22%.

An advantage of the method described in the above mentioned patent application is that by adding permanent moisture uniformly, the product may be passed direct to the silo, and the conditioning cylinder will no longer be required, thus resulting in a saving of space and equipment.

Thus a further object of the present invention is to provide a process which combines conditioning, opening and adding sufficient moisture to bring the moisture content from 18 to 22% to avoid the need for an additional conditioning process.

Because the tobacco is removed from the case or hogshead in some 300 to 400 layers, the uniform distribution of water throughout the case, compared with a cylinder where the tobacco is tumbled some 60 to 80 times whilst being sprayed, is ensured.

Further according to the present invention the process includes the step of applying water spray into the space between each lamina being separated and the tobacco below it, controlling the quantity of moisture added by the spray so that the total moisture content is between 18 and 22 percent (i.e. suitable for cutting), and feeding the separated tobacco directly to a silo to await cutting without further moisture treatment.

Yet another object of the present invention is to improve the amount of tobacco opened and conditioned for example to a figure of 6000 lbs/hr or more.

Merely increasing the feed rate of the platform would not result in a satisfactory removal of the tobacco laminae from the tobacco body since some 'pads' of leaves may be removed instead of individual leaves, whereby the forces on the blade would increase and whole leaves noticably damaged, i.e. the removal becomes mechanical rather than pneumatic.

Transfer of heat and moisture to the top layers of the case is extremely rapid, but to sub-layers is relatively slow. Leaf is typically 0.2 mm thick, but most of the leaf is folded or creased, so a nominal layer could be said to be 0.4 mm. With a jet reciprocating rate of say 90 cycles/min. and a platform feed rate of 0.4 mm/cycle the capacity is 1500 lbs/hr. So at capacities in excess of this, more than a single layer is removed.

Further, according to the invention the process comprises reciprocating the two strip jets which act in opposed directions whereby tobacco is removed during forward and return strokes. By these means the capacity may be doubled and removal of leaf facilitated.

Since the strata are not perfectly horizontal, peeling in opposite directions gives a better chance of getting under the leaves.

Figure 4:
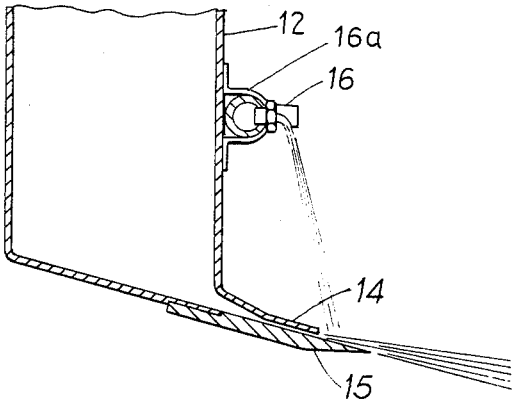
Figure 6:
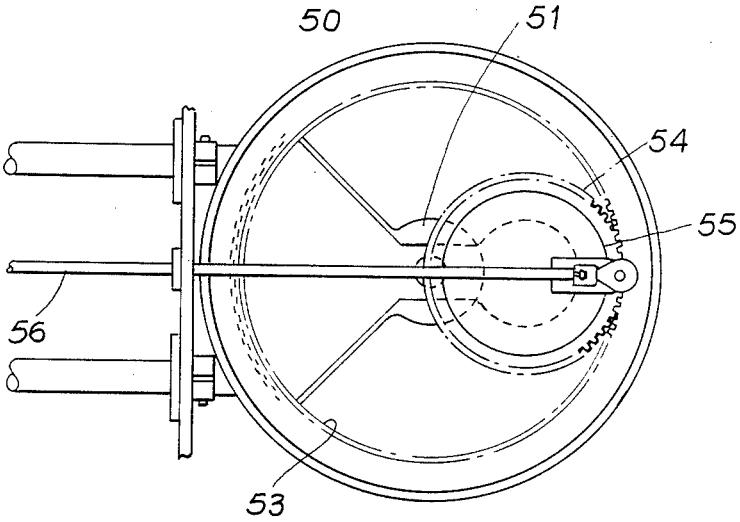
Figure 5:
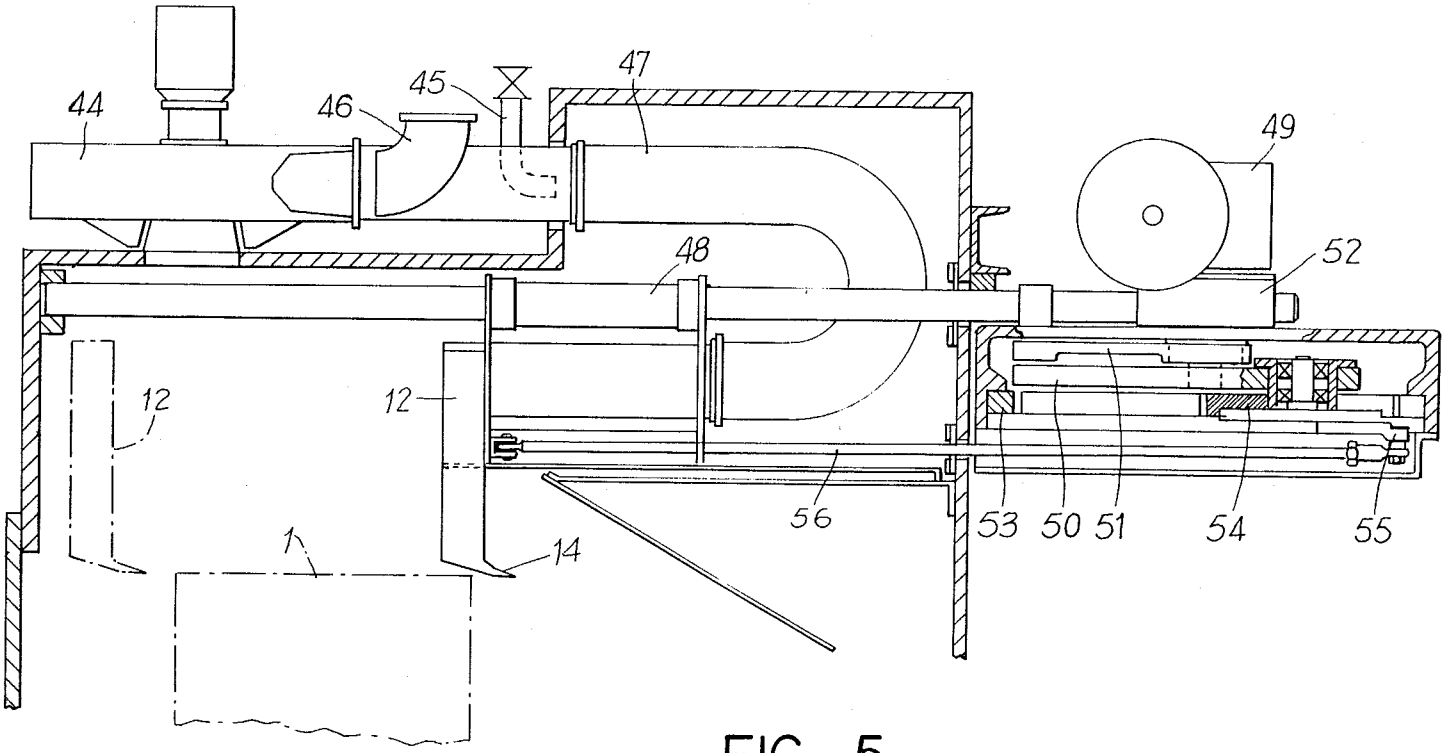
Figure 7:
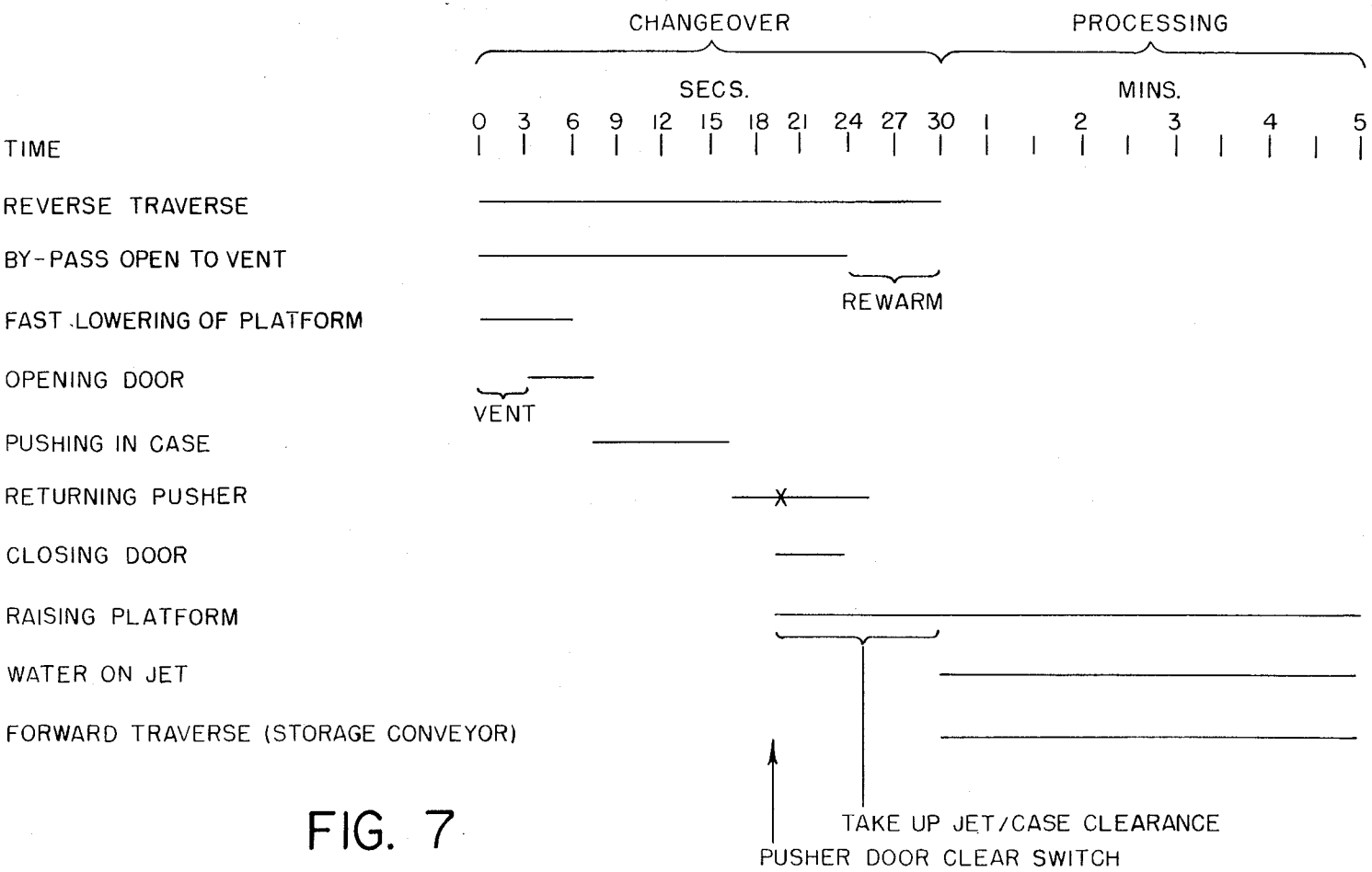
Figure 8:
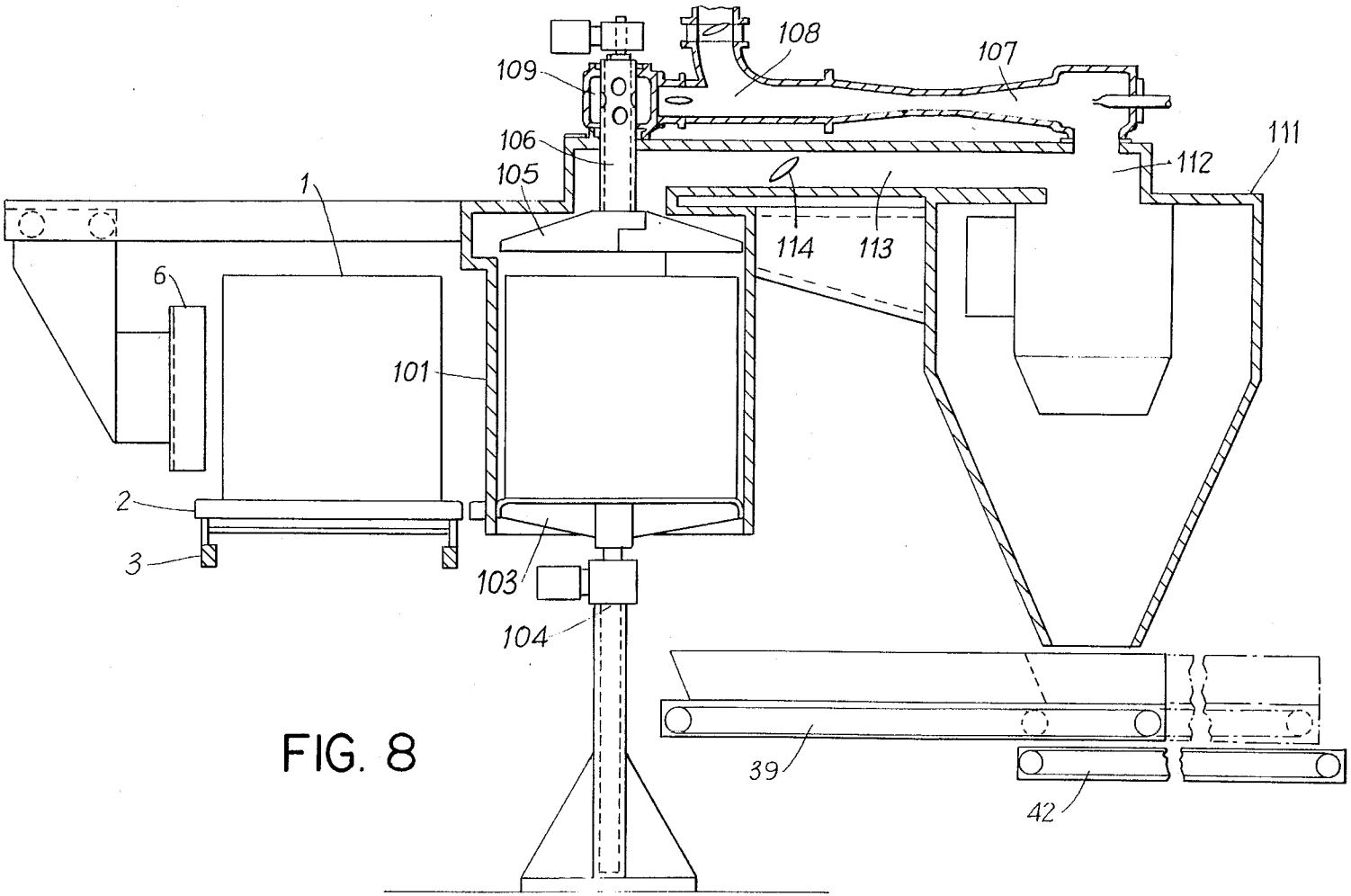
Figure 9:
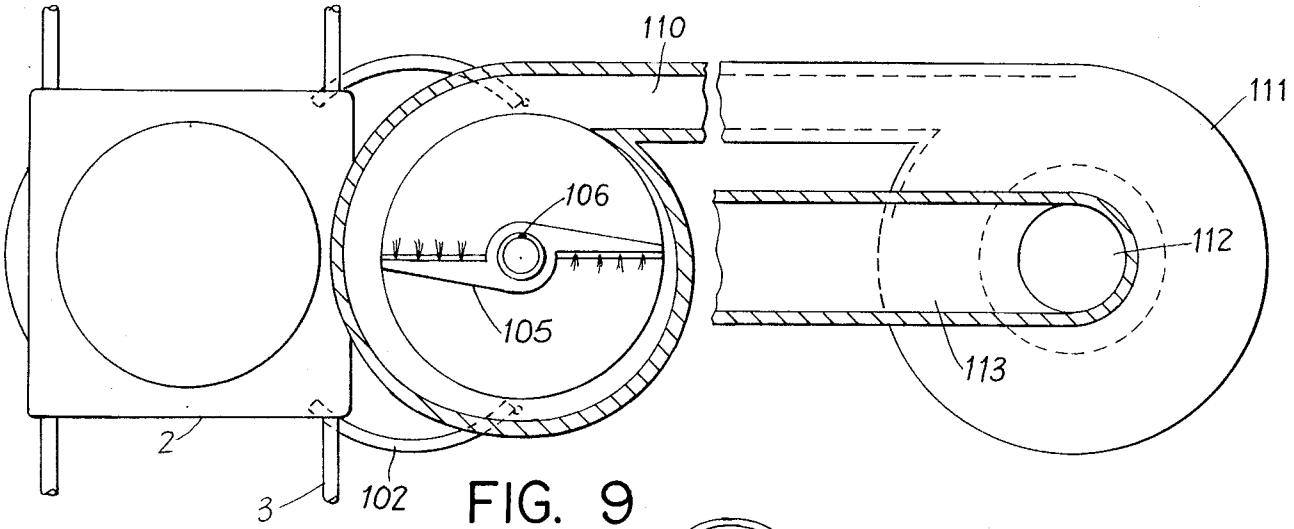
Figure 11:
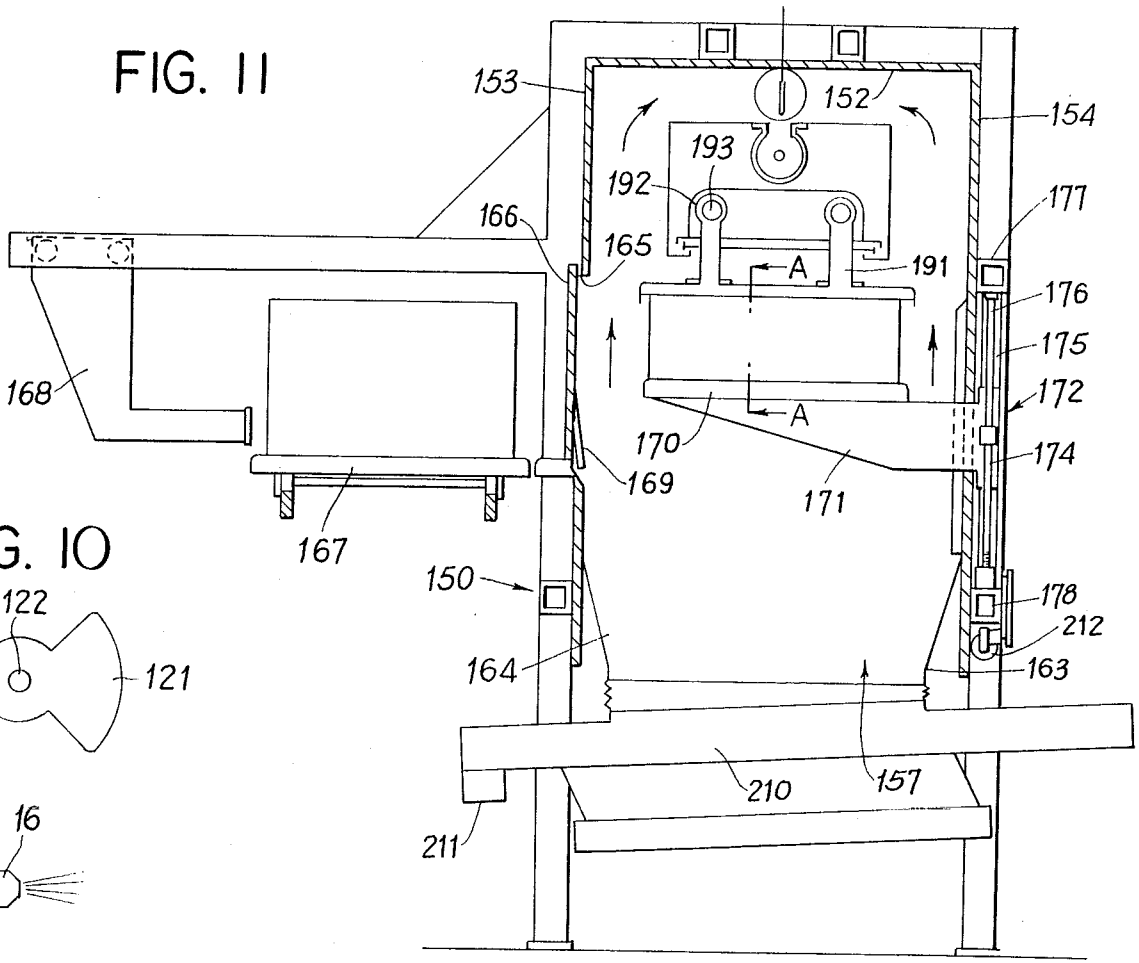
Figure 10:
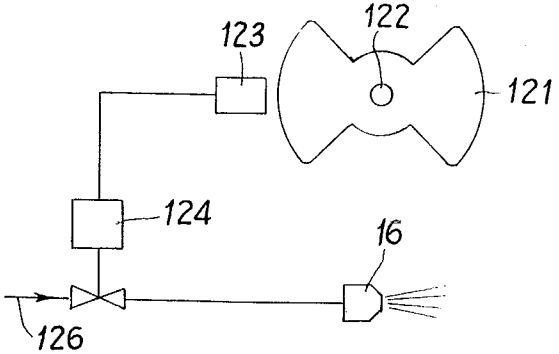
Figure 12:
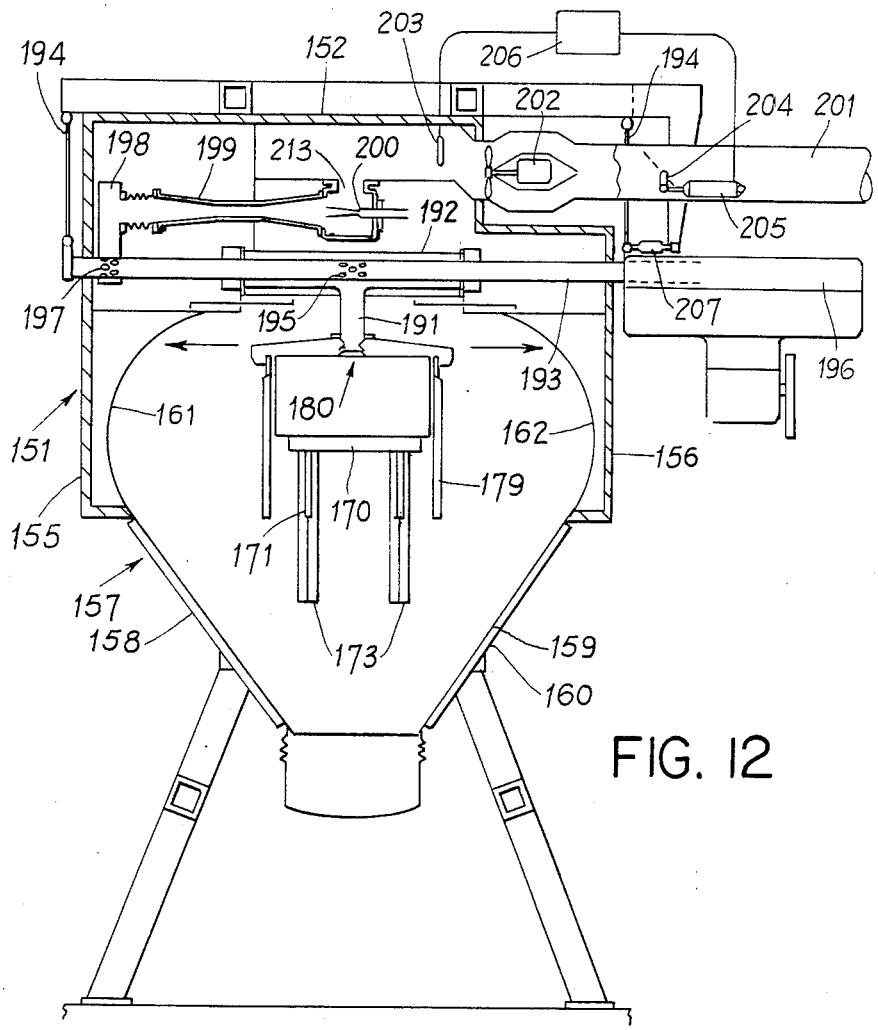
Figure 13:
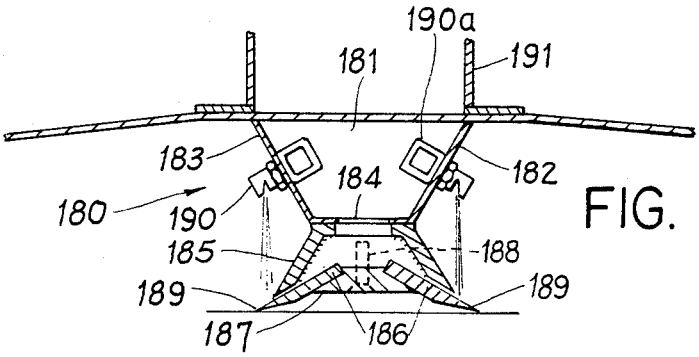
Figure 15:
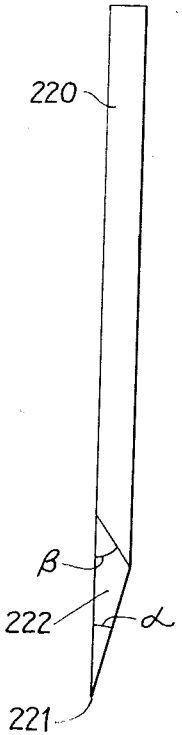
Figure 14:
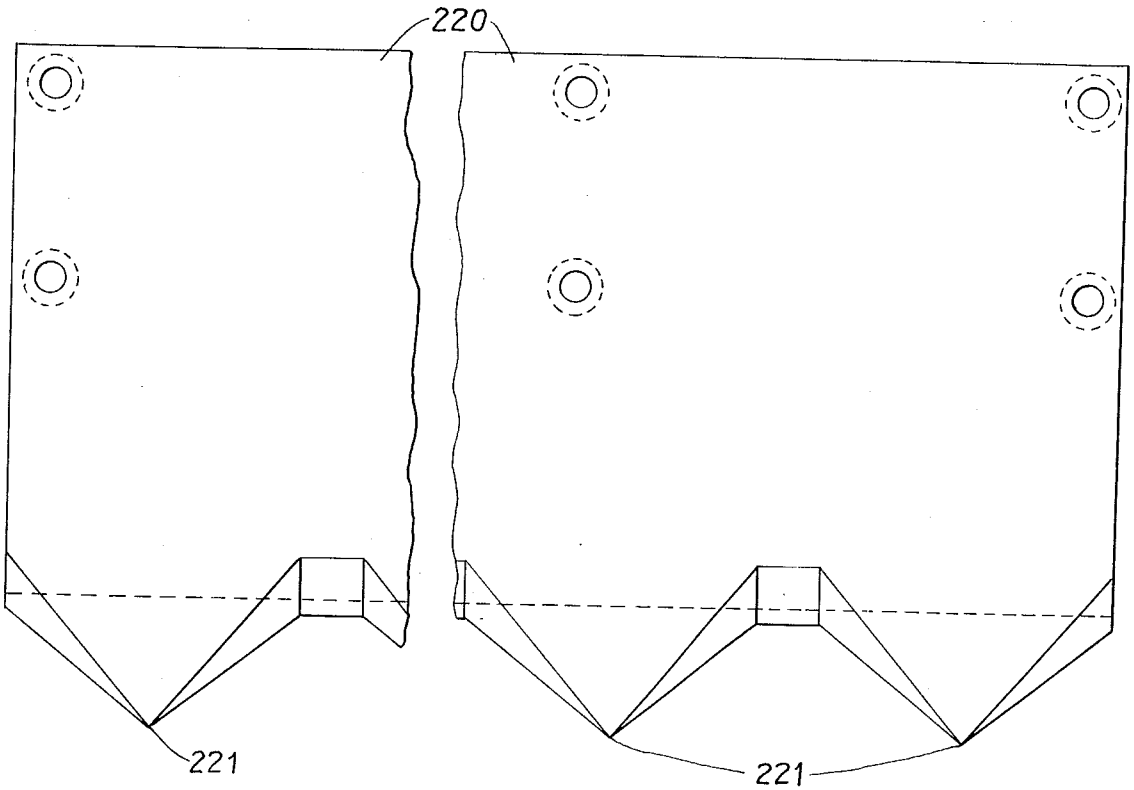

The invention will now be described by way of example with reference to the accompanying drawings, in which:

FIG. 1 shows a sectional side elevation of a case opening and conditioning apparatus, FIG. 2 shows a sectional end elevation of the apparatus, FIG. 3 shows a sectional plan view of the apparatus, FIG. 4 shows a section through a jet strip device, FIG. 5 shows an alternative drive for the apparatus in side elevation, FIG. 6 is a plan view of the apparatus with alternative drive means, FIG. 7 shows a typical processing cycle for case opening and conditioning, FIG. 8 shows a sectional side elevation of a rotary hogshead opening and conditioning apparatus, FIG. 9 shows a section plan view of the rotary apparatus, FIG. **9*a* shows a detail of the rotary jet strip device, FIG. 10 is a schematic diagram of a switching arrangement for controlling the addition of water to the strip jet, FIG. 11 is a schematic sectional elevation of another construction of the opening and conditioning apparatus having a double strip jet device with parts at one side omitted for clarity, FIG. 12 is a sectional elevation of the machine shown in FIG. 11, also with parts at the front omitted, FIG. 13 is an enlarged part section taken in the direction of the arrow A in FIG. 11, FIG. 14 is a front elevation of an alternative form of blade, and FIG. 15** is a side elevation of the alternative blade.

Referring to FIGS. 1, 2, 3 and 4, a case or hogshead 1 on trolley 2 and rails 3 can be located opposite the door 4 of the insulated process chamber 5. A powered pusher 6 is arranged to slide the case through the doorway on to the rising platform 7 which is elevated by parallelogram motion arms 8, torque shaft 9, lifting arm 10 and two speed motorised screw jack 11, operating with a slow lift and fast return.

A jet box 12 and duct 13 with strip jet (see FIG. 4) formed by a plate 14 and a peeling blade 15 spaced apart by about 1–4 mm and several water nozzles 16 are carried on a frame 17 with two slide bearings 18 running on slide bars 19.

The lower blade 15 extends beyond the plate 14 to protect the slit from the blockage of tobacco during opening. Alternatively the plate 14 may extend beyond the blade 15 in which the function would be reversed.

The blade 15 and plate 14 are positioned so that the jet slit is disposed at an angle of 15 to 45° (preferably 30°) to the horizontal. The nozzles 16 may be fed by tubes 16*a* carried by the jet box 12, said tubes being fed from a high pressure water source as necessary via flexbile hose (not shown). If desired the nozzles 16 and tubes 16*a* may be provided on the inside of the jet box 12. This avoids clogging by tobacco. The duct 13 has a bearing 20 which slides in telescope tube 21 mounted parallel with the slide bars. The whole forms a jet shuttle.

The telescopic connection provides a third bearing to support the jet box and a duct connection to the discharge from air/stream ejector 22 via a motorised butterfly flow control valve 23. The ejector is operated by steam from nozzle 24 controlled by motorised regulating valve 25 and the ejector inlet is connected to the chamber roof.

A temperature sensor 26 provides a signal which is used to control the temperature of the saturated air at the jet by automatically adjusting the air flow and steam regulating valves.

A pressure sensor 27 provides a signal which is used to maintain a slight negative pressure in the chamber by automatically adjusting the motorised butterfly by-pass valve 28 which vents to atmosphere. The negative pressure minimises saturated air leak from the open discharge chute 29.

The jet shuttle is reciprocated by two connecting rods 30 driven by two contra-rotating crank arms 31 with counter weights 32 mounted on the output shafts of two opposite hand worm boxes 33.

The worm boxes carry flywheels 34 mounted on their input shafts and are driven from a common braked motor 35 by timing belts 36. The worm boxes and motor are mounted on extensions of the slide bars.

The lamina is separated from the saturated air by the curved tangential separator plate 37 and D shaped duct 38, which forms an expanding passage of reducing air velocity.

The lamina discharges on to a traversing storage belt conveyor 39 with wheels 40 running on rails 41. The traversing conveyor discharges on to fixed position belt conveyor 42 which discharges on to take off conveyor 43. Whilst tobacco is discharging from the chamber the storage conveyor traverses slowly forward to accumulate a part of the flow. Whilst a new case is being placed in the chamber the conveyor traverses backward discharging its contents so as to maintain a continuous flow.

The jet shuttle slides are housed in a substantially separate upper compartment and the tobacco in a lower compartment. Sealed and insulated doors on each side of the machine (not shown) provide good access to both compartments for cleaning.

FIGS. 5 and 6 show alternative detail embodiments.

A single or multistage fan 44 (instead of an ejector) with separate steam nozzle 45 and by pass duct 46, provides a more flexible saturated air temperature control.

A flexible hose 47 (in place of a telescopic connection) with a four bearing frame 48 provides a pressure balanced connection to the jet shuttle.

A single drive worm box 49 with crank arm and balance weight 50 concentric contra-rotating balance weight 51 driven through reversing gearbox 52. Also with hypocyclic pinion ring gear 53, pinion 54 pivoted on the crank arm 57 and crank pin 55 mounted on the pinion provide a fully balanced straight line simple harmonic motion drive. The connecting rod does not swing so it can enter the chamber through a sliding seal, isolating the drive from the process chamber.

To ensure that the last few pounds of tobacco are not swept from the platform unseparated, the platform can be made as a plenum chamber with perforated top surface and connected to a suction source.

FIGS. 8 and 9 show an alternative embodiment for processing hogsheads.

The insulated cylindrical chamber 101 of diameter only slightly larger than a hogshead has hinged doors 102 which closes flush on the inside and a close fitting pistonlike rising platform 103 with motorised screw jack 104.

A hogshead can be pushed from a trolley into the chamber and then elevated by the platform as in the case conditioner.

Figure 9A:
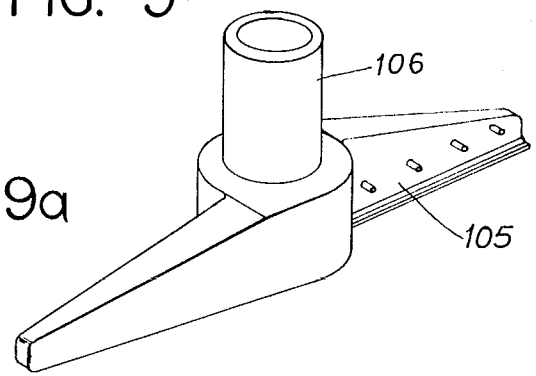

In the roof of the chamber is a motorised rotary strip jet or jets 105 (see detail FIG. 9*a*) moving in an horizontal plane about a vertical axis concentric with that of the chamber and normal to the planes of the laminations.

The jet shaft 106 is hollow and carries hot saturated air from the ejector 107 (or fan) to the strip jet or jets via by-pass 108 and rotary gland 109.

The top of the chamber is scroll shaped in plan view like a centrifugal fan casing with outlet duct 110.

During processing the hogshead is lifted against the rotary jet and the loose lamina collected by the scroll is discharged through the outlet duct to the inlet of an insulated cyclone separator 111, which separates the lamina from the air.

The air from the cyclone is recirculated back to the chamber. The air outlet 112 connects to the inlet of the ejector or fan and also directly to the top of the chamber via a secondary air duct 113. The secondary air flow can be adjusted by damper 114.

The tobacco is discharged from the cyclone through an open chute. As for the case conditioner the by-pass valve maintains a slight negative pressure in the cyclone and prevents vapour escape.

As for the case conditioner the cyclone can discharge onto a traversing storage conveyor so as to maintain a continuous output.

In order to peel lamina from the bulk surface by an air jet, sufficient kinetic energy must be used proportional to the mass of air/minute and the air velocity squared. Velocity is the more significant factor but falls off rapidly in the first few inches from the jet. Mass is less significant as only a part of the mass can be utilised in lifting lamina. So the ideal is a narrow high velocity jet placed close to the leaf surface.

The velocity squared of the air at the jet orifice is proportional to the pressure before the jet, so the energy is proportional to the pressure. In practice pressures of ½ to 2 psig (35 to 140 bar) are used with slots of 0.16" to 0.04" (4 to 1 mm) and 2 to 8 air horse power.

The wider slot passes more air and uses more power for a given pressure but the air velocity falls off less rapidly downstream of the jet, so a compromise is adopted.

The strip jet is angled at 15° to 45° from the tobacco surface so that the saturated air can penetrate between the pieces of lamina and condition, peel and blow the pieces clear.

The case with which leaf can be stripped from the bulk surface is very dependant on the bulk density. A case or hogshead averages 20 to 24 lbs/ft$^3$ (320 to 385 kg/m$^3$) but due to the uneveness of packing hard spots of 30 lbs/ft$^3$ (480 kg/m$^3$) or more are to be found requiring higher jet energies. To avoid having to use energies which would be excessive for the majority of the tobacco the strip jet orifice has one edge extended to form a peeling or skiving blade.

For moderate bulk densities the tobacco is removed at distances up to 1" (25 mm) from the jet. For local high densities the jet can touch the tobacco and the peeling blade then assists in the removal of lamina. By operating in the plane of the laminations the blade can peel each lamina with the minimum of breakage. The blade, which is moving slowly relative to the air velocity, may engage the tobacco just enough to start lifting the lamina, the air jet effecting the main lifting, conditioning and removal.

The ejector utilises the pressure energy in the steam to provide the air pressure at the jet which would otherwise be wasted in undesirable drying of the steam. It is a simple device with no moving parts but of low efficiency. But provided the air horsepower required is within the power available in the steam required to process the lamina, times the efficiency of the ejector, then it is economical. For example to process 12 cases/-hour requires a process steam rate of approximately 295 lbs/hr (134 kg/hr). Allowing 15% for the by-pass and heat losses the total could be 340 lbs/hr (115 kg/hr). This steam dropped from 100 to 20 psia (6,9 to 1,4 bar) in the ejector loses total heat at a rate equivalent to 16 HP. With a typical ejector efficiency of 25%, 4 air horsepower is available.

The alternative contrifugal fan or blower with independent steam nozzle, has one advantage over the ejector; that adjustment of the steam flow, to control the saturated air temperature, does not effect the air flow.

The fan sprays direct a curtain of water on to the peeling blade, which forms a lower extended lip of the strip jet. The water is atomised by the high velocity air and is carried with it directly on to the lamina.

The low volume high velocity jet induces a higher volume secondary air flow which assists in carrying the lamina from the tobacco surface into the separator. This secondary flow circulates back to the tobacco surface.

The chamber and loading door are both sealed. Only the discharge chute the lowest point of the chamber is open to the room. Natural convection of the hot saturated air will encourage it to escape from any gaps in the sealing of doors and etc. in the upper part of the casing. By-passing a small amount of saturated air from the ejector or fan to outside the factory will create a slight negative pressure in the chamber to discourage leaks and create a small inward flow a the discharge chute.

During the changeover period when the loading door is opened and a new case or hogshead is fed into the chamber, the escape of vapour is prevented by fully opening the by pass valve. This creates a greater negative pressure and inflow at the loading doorway.

The traversing storage conveyor is designed to maintain a continuous output of lamina during the changeover period. For example, assuming that the machine is processing 12 cases/hour and that processing time is 4½ minutes, changeover time is ½ minute then the storage conveyor must traverse forward for 4½ minutes to accumulate tobacco and backward for 1 minute to discharge it.

If the storage conveyor is 6 ft long the following speeds would be achieved:

| | ft/min | m/min |
|---|---|---|
| Fixed discharge conveyor | | |
| Forward belt speed | 120 | 36,6 |
| Traversing storage conveyor | | |
| Forward traverse speed | 1.33 | 0,41 |
| Forward belt speed | 9.99 | 3,05 |
| Backward traverse speed | 12 | 3,66 |
| Forward belt speed | 12 | 3,66 |

FIG. 7 shows a typical processing cycle for a case conditioner handling 12 cases/hour. The lefthand of FIG. 7 indicates the sequential actions which are taken to load and process a case. The top of the Figure indicates the time scale while the horizontal lines indicate the period of time required to accomplish the actions of this cycle. The Reverse and Forward Traverse actions refer to the action of the storage conveyor at the beginning and end of the cycle.

It is desirable to control the amount of water sprayed onto the space between each lamina being separated and the lamina below it in order to ensure that the total moisture content of the tobacco is between 18 and 22%. To ensure that the water sprays do not spray water down the outer surfaces of the tobacco but only on the upper surface of the surface of each layer below the layer being removed and to some extent on the lower surface of the layer being removed, means are provided cutting off supply of water to the spray nozzle or nozzles before the jet reaches the tobacco on its layer splitting stroke and as it reaches the end of its splitting off movement. As seen in FIG. 10, a double lobed cam 121 is fixed on the main crank shaft 122 which drives the shuttle, a proximity or roller switch 123, which engages with the cam and a water solenoid valve 124 which is operated by the switch. The solenoid valve controls the water flow from a pressurized water line 126 to the water sprays 16, and is normally held shut by a spring. When the switch is closed by the cam the solenoid is energised and the valve opens feeding water to the sprays. The cam lobes and gaps are adjustable so that the period for which the water is on and off is adjustable, but each may be approximately 90° and so timed that the water is off for an equal period before and after each end of the layer splitting part of the shuttle stroke.

In controlling the moisture the following points must be considered:

1. Tobacco awaiting treatment will usually have 10 to 12% moiture and the tobacco is partly cooled without evaporative loss so that 2 to 3% of the condensed moisture is retained.
2. There is a small addition of up to 1% moisture due to moisture cloud in the treatment chamber of our said apparatus. Some fresh air may be introduced into the chamber to control the chamber temperature and this may affect the moisture in the tobacco due to the cloud effect. Temperature control means for the chamber may be provided.

For improving the handling capacity, the reciprocating machine may be adapted to effect separation of the lamina on both forward and backward strokes. FIGS. 11 to 15 show a support framework 150 of another embodiment which carries an insulated enclosure 151 formed by a top panel 152 and side panels 153, 154, 155, 156. The lower end of the enclosure is constructed as a hopper 157 having inclined side walls 158, 159 provided with access panels 160, extending at the upper ends over into part cylindrical chute plates 161, 162 for collecting tobacco, one for the forward and one for the reverse stroke. The front and rear ends of the hopper are closed partly by the panels 153, 154 and partly by inclined front and rear panels 163, 164.

The rear panel 153 is provided with an entry opening 165 closed by a sliding hatch 166. A conveyor 167 brings each bale to a stationary position adjacent the opening 165 whereby the bale may be displaced laterally of the conveyor by a pusher 168. During transport of a bale a bridge flap 169 is brought into a horizontal position adjacent a platform 170 carried by a pair of cantilever forks 171 of a lifting jack 172. The flap bridges the gap between the loading and rising platforms. The forks 171 extend through vertical sealed slots 173 in the front panel 154 and are stabilised by guides 174 movable in channels 175. A ball screw jack 176 supported by cross braces 177, 178 of the framework serves to raise and lower the platform. A geared motor 212 is provided for rotating the screw 176 with a slow but adjustable upward feed rate and fast downward return.

Two vertical thrust plates 179 guide and locate the case on the platform 170 and also prevent the end 'pad' of leaves from being swept off the platform, which might otherwise occur. Automatically retractible pins may be provided which protrude about 25–50 mm above the platform surface as an alternative means of preventing end pads.

A double jet reciprocating stripping device 180 (see FIG. 13) comprises a chamber 181 defined by a pair of inclined walls 182, 183 and a bottom wall 184. A bracket 185 is fastened to the underside of the bottom wall 184 and carries two replaceable stripper blades 186 secured by an elongated clamp 187 and screws 188. The blades 186 extend beyond the bracket 185 in opposed directions by an amount to expose an upper marginal edge 189. A series of jet nozzles 190 is provided along the length of the walls 182,183 and the jets are arranged with their openings directed towards the respective marginal edges 189 of the blades.

The nozzles 190 are fed from pipes **190*a* located within the chamber 181, said pipes being fed from a high pressure water source as necessary via flexible hose (not shown), If desired the nozzles 190 and pipes 190*a* may be provided on the inside of the chamber 181**.

The jet strips are defined by the narrow spacing between the bottom edges of the bracket 185 and the blades 186.

The stripping device 180 is carried at the lower ends of two vertically disposed channels 191, which communicate internally with the chamber 181 for the purpose of delivering steam to the jet strips. The upper ends of the channels 191 depend respectively from tubes 192 which are slidably mounted on a pair of slide bar headers 193 arranged parallel to each other on suspension links 194 attached to the framework 150.

The headers 193 are provided with perforations 195 at a central position whereby the headers communicates internally with the channels 191. The tubes 192 are sealed at their ends to prevent escape of steam at these positions. However, continuous communication is maintained between the headers and channels within the limiting end positions of the tubes 192 during their reciprocation.

A hypocyclic drive arrangement 196 of the kind shown in FIGS. 5 and 6 may be provided for effecting a shuttle action of the stripping device, the limiting end positions being determined by the throw of the crank arrangement. The connecting rod moves in a straight line so that it can be sealed where it enters the chamber and that the drive can be fully balanced. This gives an advantage over the simpler drive with swinging connecting rod which cannot be sealed effectively and the secondary out of balance forces are considerable. The direction of reciprocation is at right angles to the path of travel of the bale into the apparatus.

The ends of the headers 193 are closed. One end carries the drive unit 196. Near the other end the headers communicate through perforations 197 with a manifold 198 fed with saturated air above atmospheric pressure by a steam ejector 199 with steam nozzle 200 and air inlet 213.

Saturated air emitted into the enclosure during an opening operation is exhausted from the top of the enclosure through a duct 201 containing an exhaust fan 202. The duct also contains a temperature sensor 203 upstream of the exhaust fan and a damper 204 downstream thereof. The damper position is controlled by a motor 205 from a process controller 206 receiving an input signal from the sensor 203.

The damper 204 is provided in the duct 201 to adjust the flow of cold air in the enclosure and hence the chamber temperature.

The slide bar, stripper device and drive assembly are freely suspended by the four links 194 from the main frame. Any recoil due to residual out of balance forces is therefore not transmitted to the frame.

Alternatively, by connecting a force transducer (strain gauge) 207 between the suspended assembly and main frame, the force on the blade can be measured, provided that the drive is fully balanced.

The force measurement may therefore be used to provide an automatic stop if the force exceeds a pre-set limit due to a foreign body or over dense tobacco. Alternatively, it could be used to provide a feed-back signal to reduce the platform feed rate if tobacco densities increased or to increase the feed rate if densities reduced. In this way, the output from variable density cases could be optimised to reduce degradation.

An enclosed and slightly inclined vibrating conveyor 210 collects tobacco from the two chute faces 161, 162. The conveyor is fitted with a drain 211 at its lower end which drains condensation during the warm up period, avoiding sodden leaf at start up.

The vibrating conveyor 210 can feed onto a storage band (not shown) to maintain continuity of output as previously described. However, with three or four machines in a line to provide the output required, the openers may be sequenced so that one is always loading. As an example, with four machines and a 4½ minute cycle time, there would be 3 machines processing and one loading at any one moment, 1½ minutes being available for loading.

In operation the double jet chute 180 is reciprocated over a distance equal to the width of the case and the platform 170 raised at a constant rate (e.g. 0.8 mm for each stroke of the cycle). Stripping is therefore carried out in both directions of the stroke by air/stream jets from strip jets 180 which directs the jet streams beneath the tobacco leaf. Some mechanical lifting also takes place as the blade 186 engages the undersurface of the leaf particularly where a folded leaf exists or the leaf is more densely packed. As each stroke takes place the lifted leaf is thrown by the jet pressure against the chute (161 or 162) and descends around the sides of the case to the conveyor 210.

The velocity pressure of the strip jets is not fully expended in the enclosure and some saturated air is blown out of the vibrating conveyor discharge end, creating a generally negative pressure in the chamber.

The fan reverses the flow and draws air into the chamber via the vibrating conveyor. The fresh air lowers the chamber temperature. By means of the temperature sensor and process controller the motorised damper can be automatically adjusted to control the amount of fresh air drawn into the chamber and hence control the chamber temperature which affects the tobacco conditioning.

Saturated air is fed from the ejector to the stripper assembly. But of course a fan can be used in place of the ejector and a flexible hose or telescopic connection. Though the fan has the disadvantage that extra power is required which dries the steam, the ejector uses the power in the steam and ensures that the steam is saturated and wet, which improves the heat and moisture transfer to the leaf.

Whereas, in a single jet arrangement, an air circulation is caused which tends to carry the leaf up the chute face and into the drive compartment, by providing a double jet device and symmetrically arranged chutes, the effect of the opposed jet cancels out.

The high pressure water feed to the nozzles may be cut off at the end of each stroke and may be turned on at the beginning of each stroke by the arrangement described in FIG. 10.

Instead of straight edged blades with a raked under surface toothed blades of the kind shown in FIGS. 14 and 15 may be used. The blade 220 may be 120 cm long, 10 cm wide and 5 mm in thickness to accommodate a standard case. The teeth 221 are formed by a series of notches 222 with a pitch of 5 cm. The blade may have a raked surface (e.g. $\alpha=15°$) and the notches may be cut at an angle ($\beta$) of e.g. 30°.

Thus the various embodiments described can be used with advantage to:

1. Minimise degradation by moistening and removing leaf from the top face of the case or hogshead parallel with the laminations. This is the face from which lamina can most easily be removed even when unconditioned.
2. Minimise degradation by using non-mechanical means as far as possible to remove leaf.
3. Prevent de-lamination and case end collapse by processing the case the normal way up as packed with horizontal laminations.
4. Providing controlled temperature heating and moistening means directly at the tobacco surface.
5. Minimise the energy usage by utilizing the pressure energy in the process steam to provide the opening power.
6. Providing permanent moisture addition directly at the tobacco surface.
7. Avoid the complication of the top conveyor and sprung side sealing plates by changing cases via a sealed door.
8. Treat both cases and hogsheads.

I claim:

1. An opener and conditioner of a body of tobacco lamine comprising:

a chamber for receiving a body of tobacco laminae;

a jet box having a strip jet means for emitting a jet of air and moisture in a direction oblique to the surface of the body of tobacco laminae; and means for reciprocating said jet box with respect to the body of tobacco within a plane parallel to and in close proximity to the surface plane of the tobacco laminae, said strip jet preconditioning the tobacco laminae while separating one or more laminae progressively from the body of tobacco with each reciprocating stroke of said jet box.

2. An opener and conditioner of a body of tobacco laminae as claimed in claim 1 further comprising a peeling blade inclined with respect to the plane of reciprocation and mounted on said jet box a plate spaced apart from said blade on said jet box and fixed to direct said strip jet means obliquely towards the body of tobacco laminae such that said blade can enter between the laminae being separated by said strip jet means and the next adjacent laminae during the reciprocation of said jet box.

3. An opener and conditioner of a body of tobacco laminae as claimed in claim 2 further comprising:

a feed duct connected to said jet box supplying the air and moisture to said jet box and capable of reciprocating along with said jet box and a telescopic feed tube connected to said duct for supplying the air and moisture to said duct.

4. An opener and conditioner of a body of tobacco laminae as claimed in claim 2 wherein said jet box further comprises:

means for supplying a fluidized water stream directed between adjacent laminae of the tobacco body substantially at the point of separation created by said air and moisture jet, and means for controlling the quantity of moisture added by said water supply means and said strip jet means.

5. An opener and conditioner of a body of tobacco laminae as claimed in claim 4 wherein said water supply means further comprises:

a series of water nozzles mounted on said jet box for directing water towards said blade so that the water mixes with said jet of air and moisture emitted from said jet strip and is directed toward the point of separation of the tobacco laminae.

6. An opener and conditioner of a body of tobacco laminae as claimed in claim 1 wherein said reciprocating means comprises a hypocyclic drive mechanism having a rod connected to said jet box for moving said jet box in a straight line.

7. An opener and conditioner of a body of tobacco laminae as claimed in claim 1 wherein said reciprocating means comprises:

a pair of rods connecting at one end to said jet box;

two contra rotating crank arms connected to the opposite end of said rod from said jet box;

a plurality of counter weights attached to said crank arms;

two worm drives, each of opposite hand connected to said crank arms; and means for driving said worm drives creating the reciprocating motion of said jet box.

8. An opener and conditioner as claimed in claim 1 further comprising:

a platform in said chamber for supporting the body of tobacco, and means to raise and lower said platform with respect to the plane of reciprocation.

9. A process for the opening and preconditioning of a case or hogshead of tobacco laminae comprising:

reciprocating a strip jet within a plane parallel to and in close proximity to the surface of a body of tobacco laminae, separating and removing one or more laminae progressively from the body of tobacco laminae with each reciprocation of the strip jet by directing an air and moisture jet stream from the reciprocation strip jet obliquely to the surface of the tobacco body.

10. A process according to claim 9 further comprising:

disposing the body of tobacco such that the laminae are substantially parallel to the plane of reciprocation of the strip jet, and raising the body of tobacco progressively toward the plane of reciprocation of the strip jet on each successive stroke of the reciprocating strip jet.

11. A process as claimed in claim 9 further comprising:

directing said air and moisture jet stream at an angle of between 15 and 45 degrees to the surface plane of the body of tobacco laminae.

12. A process as claimed in claim 9 further comprising:

applying a water spray into the space between adjacent laminae as separation takes place.

13. A process as claimed in claim 9 further comprising:

controlling the quantity of moisture added during the process so that the total moisture quality of the tobacco is in a range of 18 to 22 percent.

14. A process as claimed in claim 9 further comprising:

feeding the separate laminae directly into a silo to await cutting without further moisture treatment.

15. A process as claimed in claim 9 further comprising:

emitting a water spray from said strip jet.

16. A process as claimed in claim 15 further comprising:

controlling the emission of said water spray so that the spray is initiated when the strip jet engages the body of tobacco and terminates upon reaching the end of the separation stroke.

* * * * *